US005876135A

United States Patent [19]

Wang et al.

[11] Patent Number: 5,876,135

[45] Date of Patent: Mar. 2, 1999

[54] TOOTH BRUSH DEVICE HAVING A DENTIFRICE SUPPLIER

[76] Inventors: Yeou Jw Wang, No. 130, Tou Ren Lane, Lu Gang Town; Terng Yaw Lee, No. 134, Din Lie Road, Sien Hsi Hsiang, both of Chang Hua Hsien, Taiwan

[21] Appl. No.: 41,630

[22] Filed: Mar. 13, 1998

[51] Int. Cl.[6] ..... A46B 11/06

[52] U.S. Cl. ..... 401/46; 401/42; 401/289

[58] Field of Search ..... 401/289, 42, 43, 401/45, 46, 40, 44; 601/165

[56] References Cited

U.S. PATENT DOCUMENTS

| | | | |
|---|---|---|---|
| 1,682,470 | 8/1928 | Bassett | 401/43 |
| 2,855,619 | 10/1958 | Graham | 401/46 |
| 4,863,302 | 9/1989 | Herzfeld et al. | 401/289 |

*Primary Examiner*—Steven A. Bratlie

[57] ABSTRACT

A tooth brush device includes a coupler coupled to a faucet and a tube coupled to the coupler by a hose, and a tooth brush coupled to the tube. A container is coupled to the hose for supplying the dentifrice into the hose. A valve is disposed in the coupler for controlling the water to flow into the hose. A switch is disposed in the tube for controlling the water to flow through the tube. The valve may control the water to flow into the hose and the brush when an aperture of the switch is actuated to communicate with the tube.

6 Claims, 3 Drawing Sheets

TOOTH BRUSH DEVICE HAVING A DENTIFRICE SUPPLIER

BACKGROUND OF THE INVENTION

1. Field of the Invention

The present invention relates to a tooth brush, and more particularly to a tooth brush device having a dentifrice supplier.

2. Description of the Prior Art

Typical tooth brushes comprise an orifice for supplying water into the tooth brushes. However, the dentifrice may not be automatically supplied into the tooth brushes.

The present invention has arisen to mitigate and/or obviate the afore-described disadvantages of the conventional tooth brushes.

SUMMARY OF THE INVENTION

The primary objective of the present invention is to provide a tooth brush device having a dentifrice supplier for automatically supplying dentifrice into the tooth brush.

In accordance with one aspect of the invention, there is provided a tooth brush device for coupling to a faucet, the tooth brush device comprising a coupler for coupling to the faucet and for receiving water from the faucet, a tube including a first end and a second end, a container for receiving a liquid, a hose coupling the coupler to the first end of the tube for allowing the water to flow from the coupler to the tube, a pipe coupling the container to the hose for supplying the liquid into the hose, a tooth brush including a water passage and including a first end having a brush member and including a second end for securing to the second end of the tube and for allowing the water from the tube to flow through the water passage of the tooth brush and to flow through the brush member, means for securing the second end of the tooth brush to the second end of the tube, a valve disposed in the coupler for controlling the water to flow into the hose, and a switch means disposed in the tube for controlling the water to flow through the bore of the tube.

The coupler includes a chamber and an inlet for communicating the chamber with the faucet and includes a port connected to the hose, the valve is engaged in the coupler and includes an opening communicating with the inlet for receiving water from the faucet and includes two valve seats communicating with the chamber and the port respectively, the valve includes a valve stem slidably engaged therein and two plugs secured to the valve stem for engaging with the valve seats respectively, and includes a spring biasing means for biasing a first of the plugs to engage with a first of the valve seats, the port and the hose are blocked when the first plug is engaged with the first valve seat, a second of the plugs is forced to engage with a second of the valve seats against the spring biasing means when the switch means is actuated to communicate the bore of the tube with the water passage of the tooth brush.

The tube includes a cavity intersecting with the bore of the tube, the switch means includes a switch slidably engaged in the cavity and having an aperture for communicating with the bore of the tube, the switch means includes a biasing means for biasing the switch and for disengaging the aperture from the bore of the tube, the aperture of the switch is allowed to be communicated with the bore of the tube when the switch is actuated against the biasing means.

The tube includes a hole formed in the second end thereof and includes a spout slidlably engaged in the hole, the spout includes an exit communicating with the second end of the tooth brush, the spout is allowed to be extended outward of the tube for spraying purposes when the tooth brush is disengaged from the tube.

The means for securing the second end of the tooth brush to the second end of the tube includes a barrel secured to the second end of the tube and includes a control ferrule rotatably engaged on the barrel, at least one ball provided between the barrel and the control ferrule, the control ferrule includes an actuator for engaging with and for actuating the ball inward of the barrel to engage with the second end of the tooth brush and for securing the second end of the tooth brush to the second end of the tube. A spring biasing means is further provided for biasing the actuator of the control ferrule to engage with and to force the ball inward of the barrel to engage with the second end of the tooth brush.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
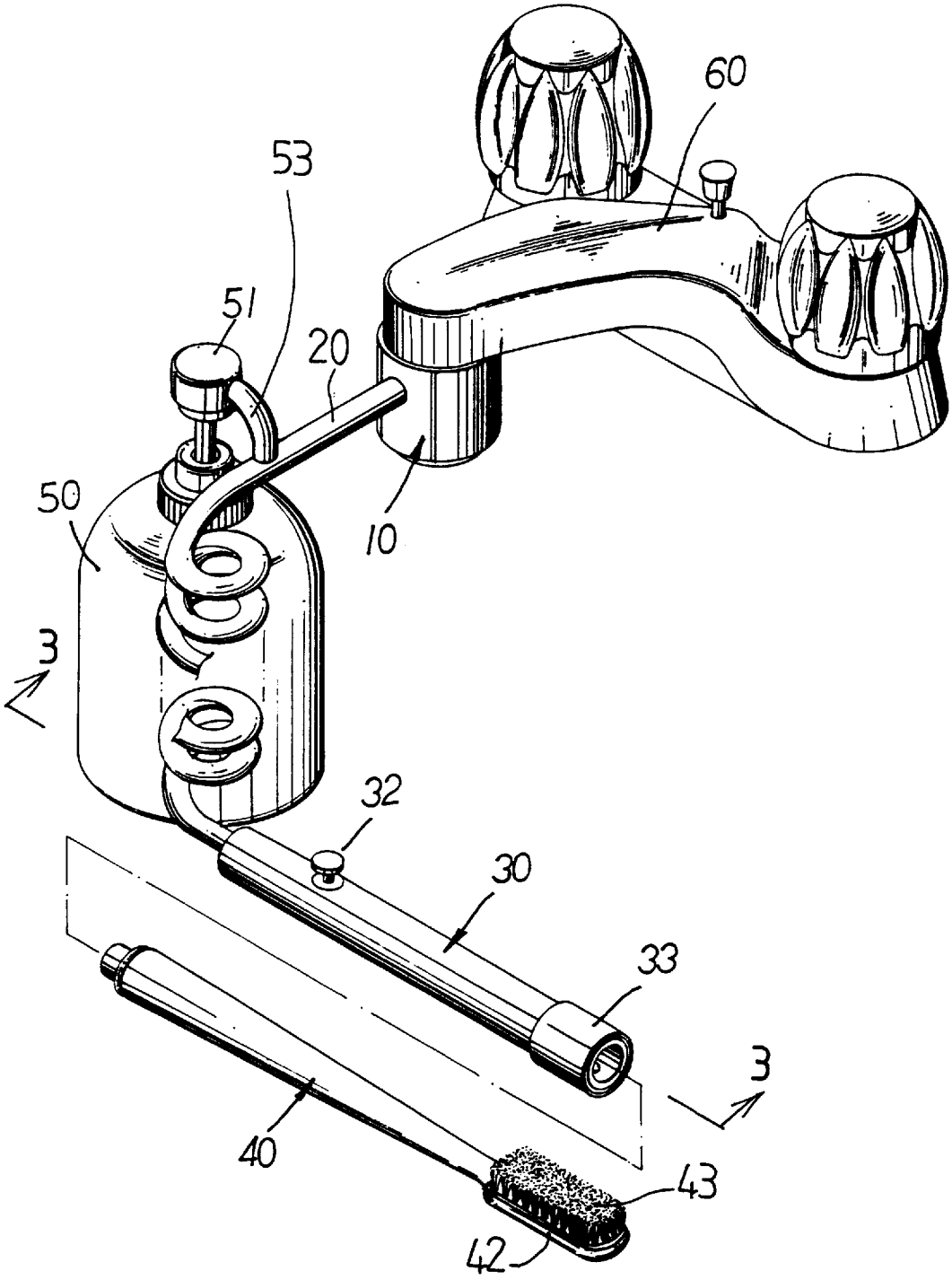
FIG. 1 is a perspective view of a tooth brush device in accordance with the present invention.
Figure 2:
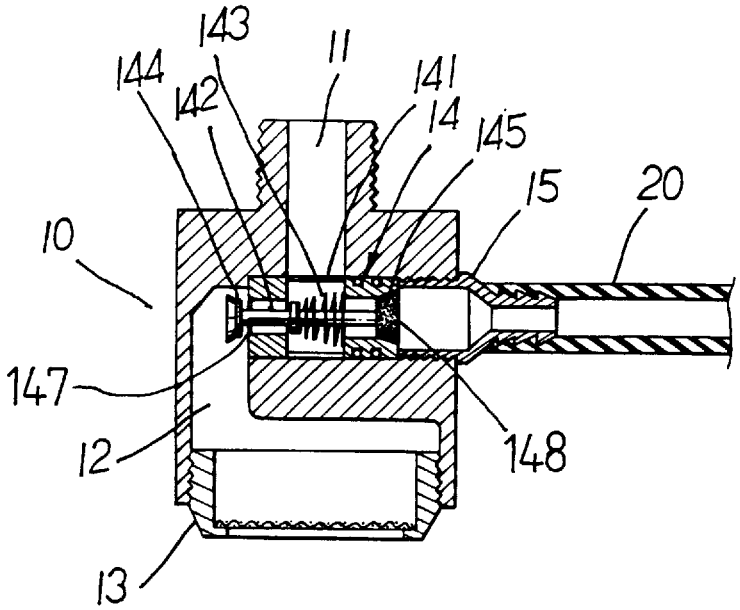
FIG. 2 is a cross sectional view of a coupler.
Figure 3:
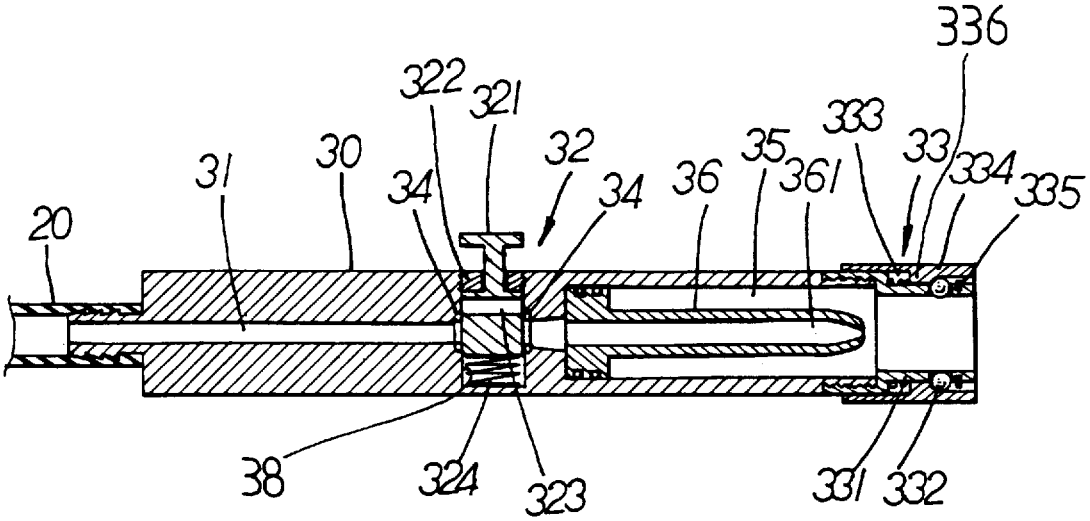
FIG. 3 is a cross sectional view taken along lines 3—3 of FIG. 1.

Referring to the drawings, and initially to FIGS. 1–3, a tooth brush device in accordance with the present invention comprises a coupler 10 for attaching to a faucet 60, a tube 30 coupled to the coupler 10 with a hose 20, and a dentifrice container 50 having a typical pump 51 coupled to the hose 20 with a pipe 53 for supplying the dentifrice into the hose 20 easily. The container 50 may also used for receiving hair shampoo or bath shampoo or wash detergent.

As shown in FIG. 2, the coupler 10 may be secured to the faucet 60 by such as threaded engagement and includes an inlet 11 for receiving water from the faucet 60. The coupler 10 includes a chamber 12 having an outlet portion and a port 15 coupled to the hose 20. A filter 13 is secured to the outlet portion of the chamber 12 for filtering the outlet water and for smoothing the outlet water and for reducing the noise of the outlet water. A valve 14 is engaged in the coupler 10 and includes an opening 141 communicating with the inlet 11 for receiving water from the faucet 60 and includes two valve seats 147, 148 communicating with the chamber 12 and the port 15 respectively for controlling the water flowing through either of the chamber 12 or the port 15. A valve stem 142 is slidably engaged in the valve 14 and includes two plugs 144, 145 for engaging with the valve seats 147, 148 respectively for controlling the water flowing through the chamber 12 and the port 15. A spring 143 is engaged with the valve stem 142 for biasing the plug 145 to engage with the valve seat 148.

Figure 5:
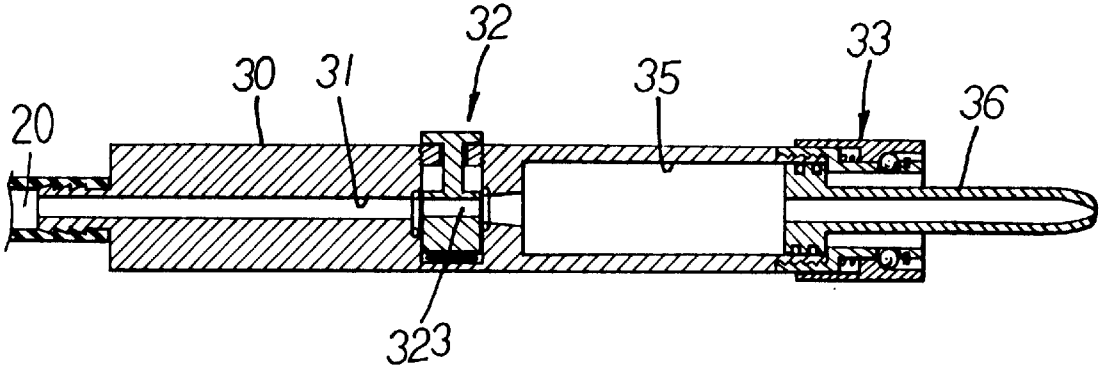

As shown in FIG. 3, the tube 30 includes a bore 31 and includes a first end connected to the hose 20 for receiving water from the hose 20 and includes a connector 33 provided in the second end for securing a tooth brush 40. The tube 30 includes a hole 35 formed in the second end and communicating with the bore 31 and located close to the connector 33 for slidably receiving a spout 36 which includes an exit 361. The spout 36 may extend outward of the tube 30 (FIG. 5) for spraying purposes. The connector 33 includes a barrel 331 secured to the second end of the tube 30 and having one or more depressions for receiving projection balls 332. A control ferrule 334 is rotatably engaged on the barrel 331 and includes an actuator 336 for engaging with the balls 332 and for forcing the balls 339 inward of the barrel 331. A spring 333 may bias the actuator 336 to engage with the balls 332. A retaining ring 335 is secured to the free end portion of the barrel 331 for preventing the halls 332 and the control ferrule 334 from being disengaged from the barrel 331.

A tooth brush 40 includes a water passage 41 and includes a brush member 43 provided on one end 42 and includes the other end engaged into the connector 33 and engaged with the spout 36 (FIG. 4) for allowing water to flow through the brush member 43 via the water passage 41. Tile balls 332 maw be forced inward of the connector 33 for engaging with and for securing the tooth brush 40 to the tube 30. The tube 30 includes a cavity 38 intersecting with the bore 31 of the tube 30 for slidably receiving a switch 32 which includes a button 321 extended outward of the tube 30 and which includes an aperture 323 for communicating with the bore 31. A spring 324 is engaged with the switch 32 for disengaging the aperture 323 from the bore 31. A lid 322 is secured to the open end of the cavity 38 for retaining the switch 32 in place. Two sealing rings 34 are provided between the two sides of the switch 32 and the tube 30 for making a water tight seal between the switch 32 arid the tube 30.

Figure 4:
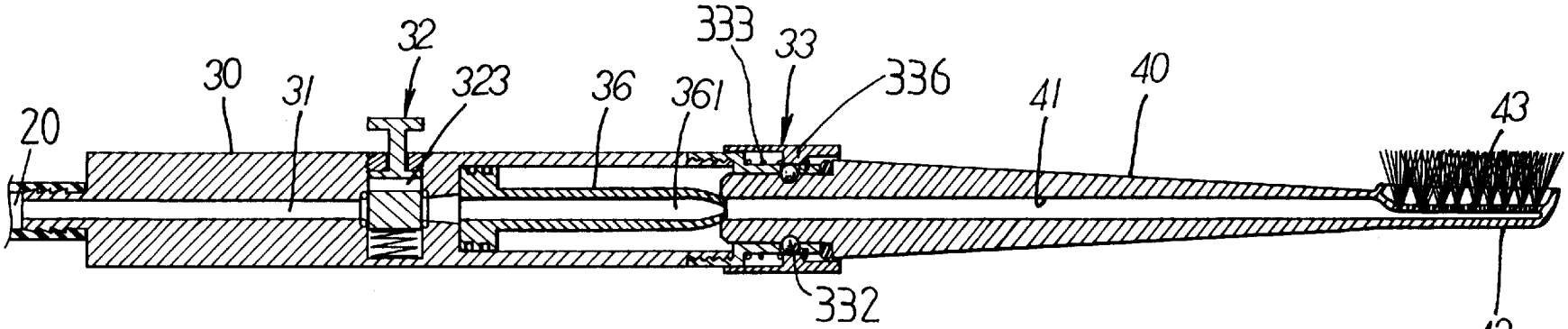
FIGS. 4 and 5 are cross sectional views similar to FIG. 3, illustrating the operation of the tooth brush device.

In operation, as shown in FIGS. 3 and 4, when the aperture 323 of the switch 32 is biased and disengaged from the bore 31, the water from the bore 31 may not flow through the tube 30 and may not flow to the tooth brush 40 such that the water from the coupler 10 may not flow into the hose 20. As shown in FIG. 2, at this moment, the water from the faucet 60 may flow through the inlet 11 and the opening 141 of the valve 14 and may flow into the chamber 12 and may flow out of the outlet portion of the chamber 12 when the plug 145 seals the valve squat 148. When the switch 32 is depressed against the spring 324 for aligning the aperture 323 with the bore 31 of the tube 30 (FIG. 5), the pressure within the tube 30 and the hose 20 is thus decreased to zero. The spring 143 and the plugs 144, 145 of the valve 14 are arranged such that the plug 145 may be forced and disengaged from the valve seat 148 against the spring 143 and the other plug 144 may be forced to seal the valve seat 147, and such that the water is allowed to flow through the hose 20 and the tube 30 and the tooth brush 40 when the switch 32 is actuated and when the aperture 323 is aligned with the bore 31. The dentifrice may be supplied into the hose 20 by actuating the pump 51.

Accordingly, the tooth brush device in accordance with the present invention includes a dentifrice supplier For automatically supplying dentifrice into the tooth brush when required.

Although this invention has been described with a certain degree of particularity, it is to be understood that the present disclosure has been made by way of example only and that numerous changes in the detailed construction and the combination and arrangement of parts may be resorted to without departing from the spirit and scope of the intention as hereinafter claimed.

We claim:

1. A tooth brush device for coupling to a faucet, said tooth brush device comprising:

a coupler for coupling to the faucet and for receiving water from the faucet, a tube including a first end and a second end, a container for receiving a liquid, a hose coupling said coupler to said first end of said tube for allowing the water to flow from said coupler to said tube, a pipe coupling said container to said hose for supplying the liquid into said hose, a tooth brush including a water passage and including a first end having a brush member and including a second end for securing to said second end of said tube and for allowing the water from a bore of said tube to flow through said water passage of said tooth brush and to flow through said brush member, means for securing said second end of said tooth brush to said second end of said tube, a valve disposed in said coupler for controlling the water to flow into said hose, and a switch means disposed in said tube for controlling the water to flow through said bore of said tube.

2. The tooth brush device according to claim 1, wherein said coupler includes a chamber and an inlet for communicating said chamber with the faucet and includes a port connected to said hose, said valve is engaged in said coupler and includes an opening communicating with said inlet for receiving water from said faucet and includes two valve seats communicating with said chamber and said port respectively, said valve includes a valve stem slidably engaged therein and two plugs secured to said valve stem for engaging with said valve seats respectively, and includes a spring biasing means for biasing a first of said plugs to engage with a first of said valve seats, said port and said hose are blocked when said first plug is engaged with said first valve seat, a second of said plugs is forced to engage with a second of said valve seats against said spring biasing means when said switch means is actuated to communicate said bore of said tube with said water passage of said tooth brush.

3. tooth brush device according to claim 1, wherein said tube ion odes a cavity intersecting with said bore of said tube, said switch means includes a switch slidably engaged in said cavity and having an aperture for communicating with said bore of said tube, said switch means includes a biasing means for biasing said switch and for disengaging said aperture from said bore of said tube, said aperture of said switch is allowed to be communicated with said bore of said tube when said switch is actuated against said biasing means.

4. The tooth brush device according to claim 1, wherein said tube includes a hole formed in said second end thereof and includes a spout slidably engaged in said hole, said spout includes an exit communicating with said second end of said tooth brush, said spout is allowed to be extended outward of said tube for spraying purposes when said tooth brush is disengaged from said tube.

5. The tooth brush device according to claim 1, wherein said means for securing said second end of said tooth brush to said second end of said tube includes a barrel secured to said second end of said tube and includes a control ferrule rotatably engaged on said barrel, at least one hall provided between said barrel and said control ferrule, said control ferrule includes an actulator for engaging with and for actuating said at least one ball inward of said barrel to engage with said second end of said tooth brush and for securing said second end of said tooth brush to said second end of said tube.

6. The tooth brush device according to claim 5 further comprising means for biasing said actuator of said control ferrule to engage with and to force said at least one ball inward of said barrel to engage with said second end of said tooth brush.

* * * * *